US008096406B1

(12) United States Patent
Mitchell, III

(10) Patent No.: US 8,096,406 B1
(45) Date of Patent: Jan. 17, 2012

(54) SYSTEM AND METHOD FOR CONTROLLING CASTING SHAKEOUT RETENTION

(75) Inventor: Charles Edwin Mitchell, III, Mt. Washington, KY (US)

(73) Assignee: Carrier Vibrating Equipment Co., Louisville, KY (US)

( * ) Notice: Subject to any disclaimer, the term of this patent is extended or adjusted under 35 U.S.C. 154(b) by 0 days.

(21) Appl. No.: 12/759,354

(22) Filed: Apr. 13, 2010

Related U.S. Application Data

(62) Division of application No. 11/278,606, filed on Apr. 4, 2006, now Pat. No. 7,712,513.

(51) Int. Cl.
*B65G 27/16* (2006.01)
*B65G 47/00* (2006.01)

(52) U.S. Cl. ..... 198/766; 198/617

(58) Field of Classification Search ..... 198/752.1, 198/761, 762, 766, 770, 771, 617
See application file for complete search history.

(56) References Cited

U.S. PATENT DOCUMENTS

| | | | | |
|---|---|---|---|---|
| 2,302,870 | A | 11/1942 | Kennedy et al. | |
| 2,958,228 | A | 11/1960 | Carrier, Jr. et al. | |
| 3,053,379 | A | 9/1962 | Roder et al. | |
| 3,449,969 | A | 6/1969 | Dorris | |
| 3,727,677 | A | 4/1973 | Thomas | |
| 4,185,681 | A | 1/1980 | Church et al. | |
| 4,722,386 | A | 2/1988 | Casey | |
| 4,830,597 | A | 5/1989 | Steier et al. | |
| 5,005,439 | A | 4/1991 | Jensen et al. | |
| 5,054,606 | A | 10/1991 | Musschoot | |
| 5,064,053 | A | 11/1991 | Baker | |
| 5,213,150 | A | 5/1993 | Sensenstein | |
| 5,392,898 | A | 2/1995 | Burgess et al. | |
| 5,404,996 | A | 4/1995 | Durnil | |
| 5,460,219 | A | 10/1995 | Massin et al. | |
| 5,505,247 | A | 4/1996 | Musschoot | |
| 5,597,031 | A | 1/1997 | Weimann | |
| 5,615,763 | A | 4/1997 | Schieber | |
| 5,669,435 | A | 9/1997 | Goss | |
| 5,713,457 | A | 2/1998 | Musschoot | |
| 5,924,473 | A | 7/1999 | Musschoot | |
| 6,024,210 | A | 2/2000 | Rosenstrom | |
| 6,279,731 | B1 * | 8/2001 | Anderson | 198/763 |
| 6,390,174 | B1 | 5/2002 | Bloch et al. | |
| 6,398,013 | B1 * | 6/2002 | Svejkovsky et al. | 198/750.8 |
| 6,415,911 | B1 * | 7/2002 | Svejkovksy et al. | 198/750.1 |
| 6,527,104 | B2 * | 3/2003 | Svejkovsky et al. | 198/769 |
| 6,622,775 | B2 | 9/2003 | Crafton et al. | |
| 6,644,382 | B1 | 11/2003 | Aoyama et al. | |
| 6,659,267 | B2 * | 12/2003 | Patterson | 198/771 |

(Continued)

FOREIGN PATENT DOCUMENTS

| | | |
|---|---|---|
| EP | 4417162 | 11/1995 |

*Primary Examiner* — Douglas Hess
(74) *Attorney, Agent, or Firm* — Alexander P. Brackett; John F. Salazar; James E. Cole

(57) ABSTRACT

A method for controlling the retention time of a casting retained in a mold comprises providing a vibratory shakeout conveyor having a conveying surface, placing the mold on the conveyor; and imparting a vibratory force to the conveyor at a predetermined angle to the conveying surface whereby the predetermined angle determines the retention time of said casting in said mold. A plurality of sensors for detecting mold position and media breakdown may also be employed to detect appropriate mold retention time.

19 Claims, 4 Drawing Sheets

U.S. PATENT DOCUMENTS 6,868,960 B2 * 3/2005 Jones ..... 198/770
RE38,756 E * 7/2005 Kraus et al. ..... 198/764
6,991,091 B2 * 1/2006 Thomson et al. ..... 198/752.1
7,240,800 B2 7/2007 Musschoot et al.
7,387,198 B2 * 6/2008 Thomson ..... 198/770
7,426,991 B1 * 9/2008 Cedzo et al. ..... 198/760
7,509,994 B2 3/2009 Aoyama et al.
7,581,646 B2 * 9/2009 Barr ..... 209/235
7,650,986 B2 * 1/2010 Kwasniewicz ..... 198/750.8

* cited by examiner

SYSTEM AND METHOD FOR CONTROLLING CASTING SHAKEOUT RETENTION

CROSS-REFERENCE TO RELATED APPLICATIONS

This application for patent is a divisional application of, and claims the benefit of co-pending U.S. patent application Ser. No. 11/278,606 filed Apr. 4, 2006, and entitled "System and Method for Controlling Casting Shakeout Retention".

FIELD OF THE INVENTION

The present invention is related generally to a system and method for advancing an article on a vibratory conveyor and more specifically to a system and method for controlling the retention time of an article being conveyed by selective and directional application of a vibratory force to a conveyor as a function of at least one sensed variable.

BACKGROUND OF THE INVENTION

There are known in the art a plurality of commercially available vibratory conveyor systems for controlling the speed and direction of articles or materials being conveyed thereby. Many prior art systems vary conveying speed and direction by changing either the direction or magnitude of a force applied to a conveyor trough that is resiliently mounted on a suspension system to permit vibratory motion to be imparted thereto. Alternative prior art conveying systems employ a wide variety mechanical systems to elevate or decline an end of the vibratory conveyor, thereby changing the angle of inclination of the entire conveyor trough to speed up or slow down the progress of an article along the conveyor.

One exemplary prior art system of this nature is U.S. Pat. No. 5,615,763 to Schieber, assigned to Carrier Vibrating Equipment, Inc., of Louisville, Ky., herein incorporated by reference. Generally speaking, this systems varies the vibratory force being applied to a resiliently mounted conveyor trough by securing to the trough a plurality of shafts having a plurality of eccentric weights mounted thereto. The shafts, and consequently the eccentric weights, are capable of rotation, typically through the action of driven pulleys or the like such that the rotating shafts and eccentric weights impart a vibratory force to the conveyor trough.

The angle of the vibrating force acting on the conveyor in such systems is determined by the relative position of the eccentric weights on the rotating shafts. The relative position, or phase angle relationship between eccentric weights may be maintained and controlled by various mechanical control and positioning systems or alternatively, by utilizing an electronic control system to monitor and adjust the phase angle relationships between various rotating masses.

Prior art vibratory conveyor systems are incapable of monitoring an article being conveyed to adjust the speed and direction of conveyance to impart a desired amount of vibratory force to an article before its discharge from the conveyor. The ability to monitor an article's position or progress along the conveyor can be very beneficial for certain products and manufacturing processes that require the input of a particular amount of force over a given time period for proper production. For example, some casting and molding processes utilize vibratory force to separate a casting or part from its mold and concomitant media. In many prior art systems, foundries utilize vibratory shakeout devices to mechanically separate sand or other surrounding media used in the casting process from the casting itself.

In operation, prior art vibratory shakeout devices have attempted to control the time a casting is retained in its mold by changing the elevation of one end of the shakeout to change the angle of inclination of the conveyor trough. Longer casting retention times are typically required for more complete media removal whereas short retention times are desirable for more fragile castings since a shorter retention time typically requires that less vibratory force is imparted through the conveyor trough to the fragile casting. Increasing the angle of inclination of a shakeout typically increases the retention time of a casting in the mold and, conversely, decreasing shakeout inclination usually decreases mold retention time.

Many prior art shakeout systems utilizing angle of inclination type control systems are relatively unreliable since they typically employ complex mechanical systems such as air bellows or hydraulic cylinders to elevate an end of the shakeout. These mechanical systems are inherently unreliable, particularly in the harsh industrial environment of a foundry or other molding facility. Furthermore, many prior art systems offer only a limited range of process control since the angle of inclination can only be raised a few degrees before the ability to convey the casting forward along the conveyor trough ceases unless a tremendous amount of vibratory force is applied. Additionally, variations in casting speed are difficult to effect with these prior art systems.

SUMMARY OF THE INVENTION

The present invention provides a system and method for controlling the retention time of an article on a vibratory conveyor that modifies the angle of the vibratory force imparted to the conveyor as a function of the desired retention time or alternatively, as a function of article position on the conveyor or another sensed variable that is indicative of article progress. The present invention provides an electronically adjustable system for controlling conveyor retention time that permits an article being conveyed to be monitored such that a desired result is achieved prior to the article being discharged from said conveyor. For example, the present invention may be employed to monitor casting retention in a mold and adjust or modify that retention time based on a desired retention time or alternatively based on other sensed variables such as article position, relative amount of media removal, or both.

The invention comprises a vibratory shakeout conveyor that may utilize an electronic control system to modify the relative angle of the vibratory force applied to the conveying surface responsive to a desired retention time, either as input by an operator or responsive to a sensed variable such as casting position or media removal. A plurality of sensors may be employed, both to monitor and adjust the resultant angle of vibration and also to monitor the progress of the article being conveyed and its condition or status relative to a desired status prior to advancing the article.

The present invention may incorporate at least one electric motor that is capable of being electronically controlled, for example by a variable frequency drive, responsive to an resultant angle of vibration or speed input supplied thereto. The motor speed is readily adjusted to modify the relative speed of a rotating shaft or shafts, thereby changing the resultant angle of vibratory force being applied to said conveyor. Other objects, features, and advantages of the present invention will become apparent upon an examination of the detailed description of the preferred embodiment taken in conjunction with the drawing Figures.

BRIEF DESCRIPTION OF THE DRAWING FIGURES

DETAILED DESCRIPTION

Figure 1:
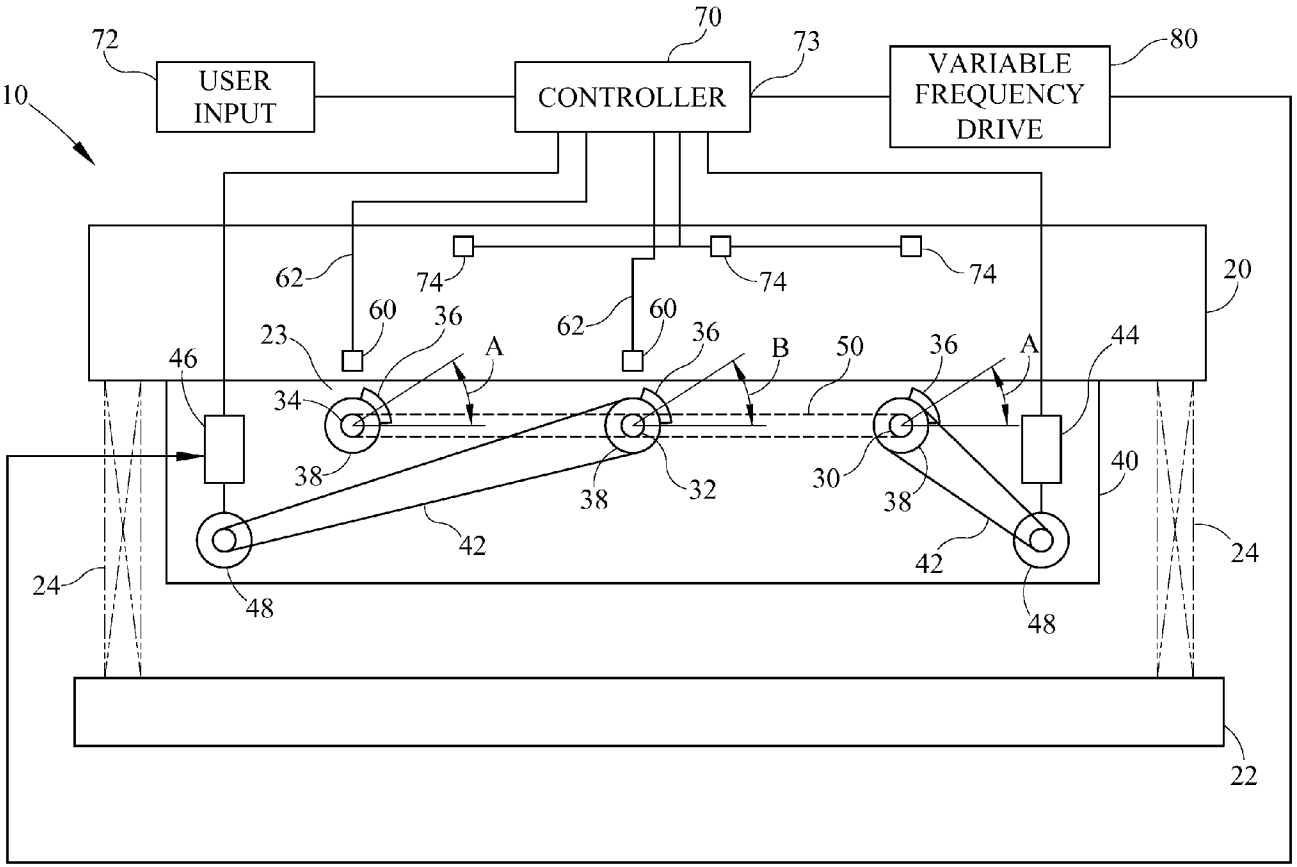
FIG. 1 is a block diagram of a vibratory conveyor and control system in accordance with one embodiment of the present invention.

Referring now to the drawing Figures, and in accordance with a preferred constructed embodiment of the invention, a system 10 and method for controlling the retention time of an article comprises a vibratory conveyor 20 including a trough or conveying surface 21 which is mounted on a stationary base 22 by a plurality of isolating springs 24 or equivalent resilient mounting means. A plurality of shafts 30, 32, and 34 are mounted for rotational motion within a frame 40. Each shaft further includes at least one eccentric weight 36 positioned at a point between the ends thereof that rotates with its respective shaft. In one embodiment of the present invention an exemplary system 10 may employ a plurality of eccentric weights 36 centrally positioned on shaft 32 while the outboard shafts 30 and 34 may employ just a single eccentric weight 36. Each shaft further includes a pulley 38 mounted thereon that is driven by a belt 42 that is in turn driven by a pair of motors 44 and 46 respectively, each having associated pulleys 48 secured to their output shafts.

In an exemplary embodiment of the present invention as shown in FIG. 1 rotating motor 44 drives shaft 30 through belt 42. Belt 50 is coupled to shaft 30 to drive shaft 34 such that both shafts 30 and 34 are synchronously rotated by operation of motor 44. In effect shaft 34 operates as a slave to shaft 30. Additionally, motor 46 drives middle shaft 32 via pulley 48 and belt 42, preferably in a rotational direction opposite to that of shafts 30 and 34.

The system 10 thus far described comprises an eccentric weight vibratory conveyor 20 capable of altering the direction of the resultant force acting on conveyor 20 due to the centrifugal forces imparted thereto by the rotating eccentric weights 36. The direction of the resultant force acting on conveyor 20 is dependent upon the relative phase angle between the positions of the rotating eccentric weights 36. Accordingly, by varying that relative position or relative phase angle between the shafts and therefore the weights 36, the direction or angle of resultant vibratory force acting on conveyor 20 is varied so that the conveying rate and direction of material placed on conveyor 20 can be altered.

The system 10 may further comprise a plurality of proximity sensors or switches 60 positioned proximate shafts 32 and 34 capable of sensing the position of the respective shafts by sensing a flag or other detectable element located thereon, as is well known to one of ordinary skill in the art. Sensors 60 provide an output 62 responsive to a sensed shaft position that is operatively connected to a controller 70. Controller 70 may comprise a conventional microcontroller having a processor, an associated data memory and a plurality of inputs and outputs that may be operatively coupled to external devices as discussed further herein below.

Controller 70 calculates an actual value of relative phase angle $Ø_1$ between shafts 32 and 34 by comparing the shaft position signal inputs 62. A manually operated user input 72, which may comprise a known in the art potentiometer, thumbwheel switch, or alternatively a numerical keypad having an output representative of a user's selection, may be adjusted to provide a desired speed and direction signal to controller 70. It should be noted that user input 72 may be either a desired relative phase angle setting or alternatively a speed and direction setting. In the case of the latter, controller 70 may be suitably programmed to mathematically convert a desired speed and direction setting supplied by user input 72 to a desired phase angle either by use of a look up table or a suitable mathematical formula, as is well known to one of ordinary skill in the art.

The controller 70 provides an output signal 73 representative of a desired motor 46 speed to a variable frequency drive 80 or equivalent electronic motor controller, thereby altering the speed of motor 46 to change the relative phase angle between shafts 30, 34, and shaft 32. The signal 73 sent to variable frequency drive 80 is continuously adjusted by controller 70 to maintain a desired relative phase angle thereby advancing an item positioned on vibratory conveyor 20 as desired.

In an alternative embodiment of the invention, a plurality of photo-eyes, motion detection, or infra-red sensors 74 or equivalent sensors are positioned at a plurality of locations along vibratory conveyor 20 to sense the progress and position of an article placed thereon. The sensors 74 include associated outputs 76 operatively connected to a plurality of inputs of controller 70. Sensors 74 are positioned at various points along the path of articles being conveyed to monitor the advancement of the articles or alternatively the amount of media breakdown which has occurred in a mold containing a casting, which in turn may be used to vary relative phase angle Ø and alter conveying speed and/or direction as discussed in detail herein below.

Figure 2:
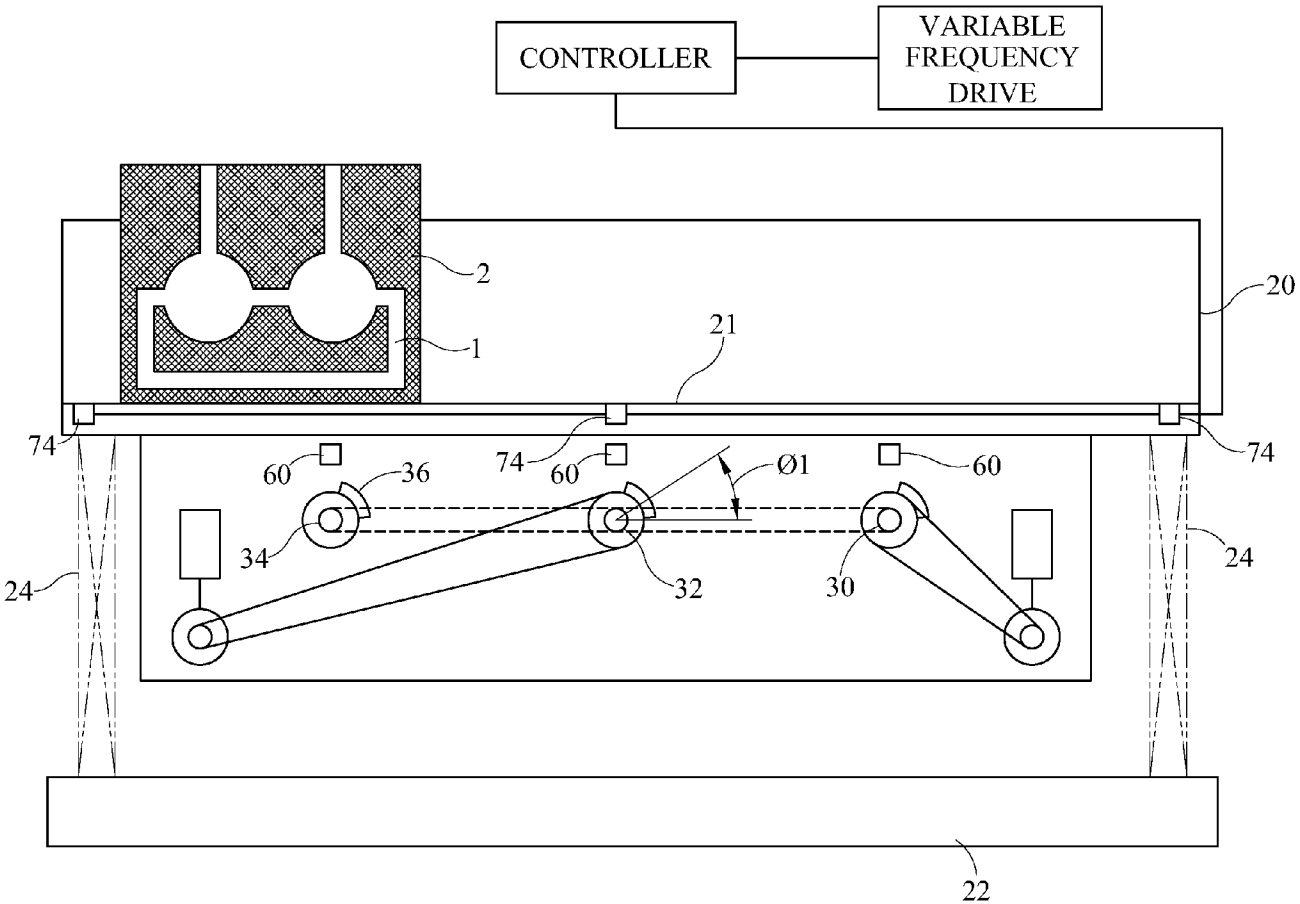
FIG. 2 is a block diagram of a vibratory conveyor and control system in accordance with one embodiment of the present invention.
Figure 3:
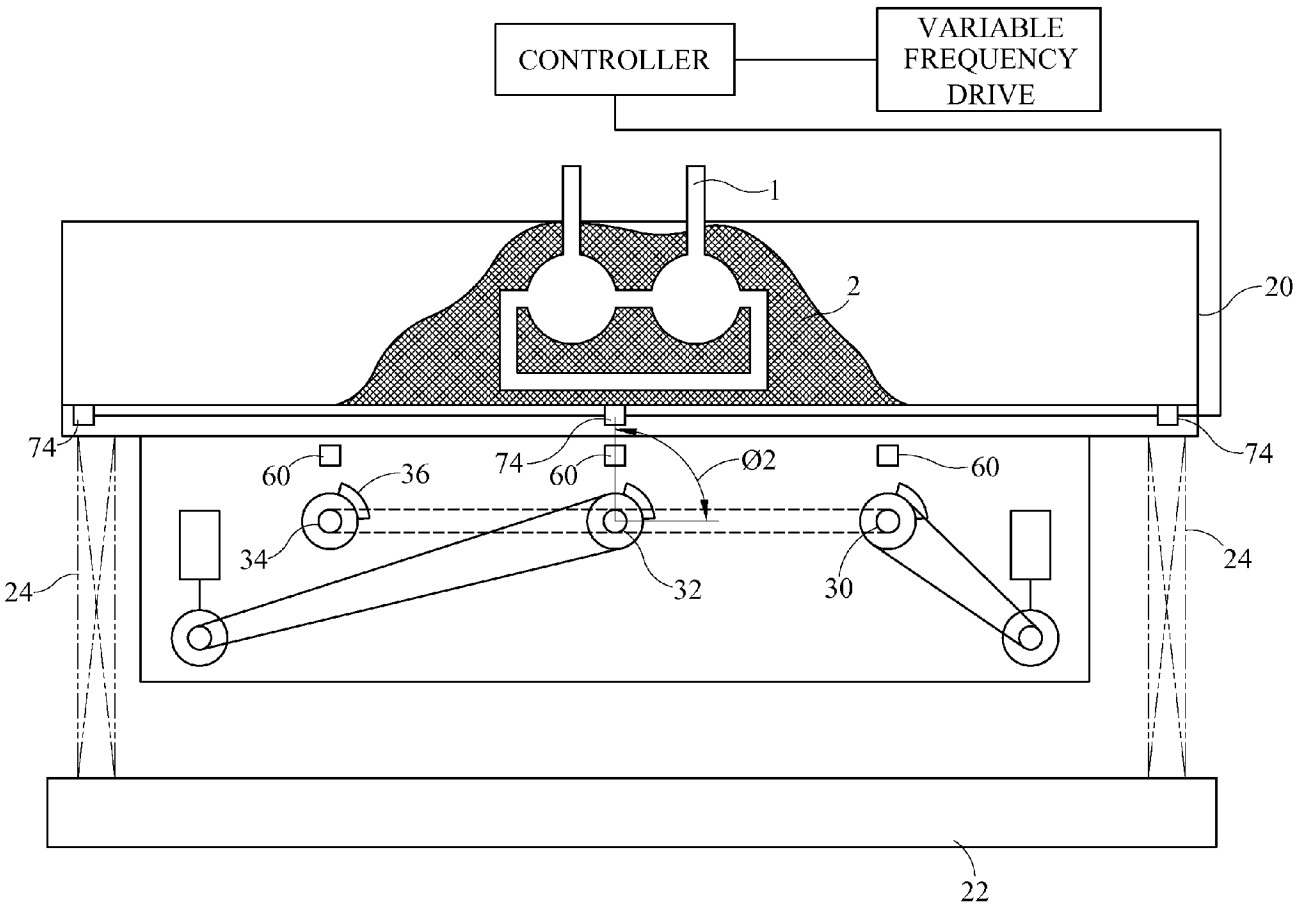
FIG. 3 is a block diagram of a vibratory conveyor and control system in accordance with one embodiment of the present invention.
Figure 4:
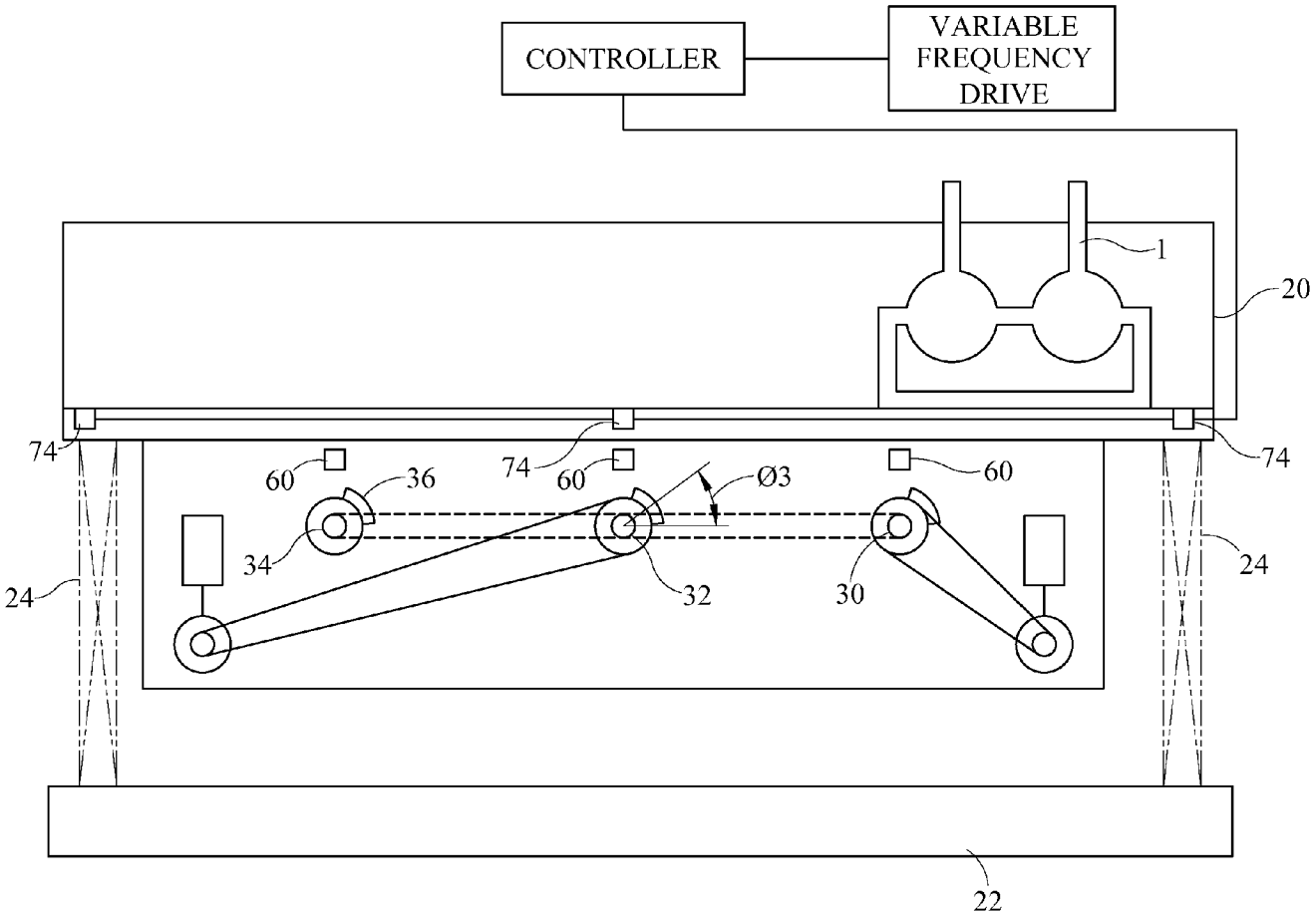
FIG. 4 is a block diagram of a vibratory conveyor and control system in accordance with one embodiment of the present invention.

Referring to drawing FIGS. 2-4 there is shown a conveyor 20 onto which a mold and casting 1 has been positioned to enable the breakdown of the media 2 surrounding casting 1 through the application of vibratory force. FIG. 2 depicts casting 1 at an initial point on the vibratory conveyor 20. As casting 1 advances along vibratory conveyor 20 (from left to right in the FIGS. 2-4) the resultant angle of vibration $Ø_1$ is set to permit the casting 1 to advance to a predetermined position along conveyor 20.

At that predetermined position depicted in FIG. 3, the controller 70 increases the resultant angle of vibration to $Ø_2$ by altering output 73 to variable frequency drive 80 to slow the advancement of casting 1 and aid the breakdown of media 2. As the media 2 breaks down the angle of vibration may be increased to a point whereby casting 1 ceases advancing completely but maximum vibratory force is being imparted to conveyor 20. Once media 2 has broken down and substantially vibrated away from casting 1, the resultant angle of vibration is then decreased to $Ø_3$ to effect the advancement and discharge of casting 1 from conveyor 20, as shown in FIG. 4.

The requisite changes to the resultant angle of vibration Ø applied to conveyor 20 may be effected by a plurality of embodiments of the present invention. In one exemplary embodiment, a first sensor 74 is a motion detection sensor, for example a commercially available PIR sensor or its equivalent that is capable of detecting motion at a point or area in space and producing an output responsive thereto, coupled to an input of controller 70. In its initial state, controller 70 advances casting 1 along conveyor 20 at predetermined angle $Ø_1$ (and thus at a predetermined speed) until the casting reaches a point where sensor 74 detects the presence of casting 1 and sends an output to controller 70. Once controller 70 senses the output from sensor 74 indicating the presence of casting 1 controller 70 then sends a new speed signal 73 to variable frequency drive 80 to alter the speed of motor 46 and increase the resultant angle of vibration to $Ø_2$ to stop the advancement of casting 1 and facilitate the breakdown of media 2.

The controller 70 may, in one embodiment of the present invention, simply set the resultant angle of vibration to $Ø_2$ for a predetermined time period selected to permit media 2 to substantially breakdown, whereupon controller 70 then automatically provides a new speed signal 73 to variable frequency drive 80 to change the resultant angle of vibration to $Ø_3$ to discharge casting 1 from conveyor 20.

In a yet further embodiment of the present invention, a second sensor 74, for example a photo-eye or its equivalent is positioned at a point proximate the area of conveyor 20 where casting 1 stops advancing (at resultant angle of vibration $Ø_2$) to sense when media 2 has substantially broken down. Stated another way, second sensor 74 is capable of detecting the absence of media 2 proximate casting 1 and sends a signal to controller 70 indicating that casting 1 is ready to be discharged from conveyor 20. Alternatively, second sensor 74 may comprises one of a plurality of commercially available digital cameras that are capable of detecting surface voids or imperfections in a viewing area. In this embodiment of the invention, the digital camera may readily determine the absence (or presence) of media 2 in a given are when casting 1 has reached a predetermined positioned and send an output indicative of a predetermined media breakdown to controller 70.

In an additional embodiment of the present invention controller 70 operates vibratory conveyor 20 in a pulse mode wherein once casting 1 enters conveyor 20 the resultant angle of vibration Ø is alternately increased and decreased to impart a greater, then lesser vibration to casting 1. In this fashion, articles placed on conveyor 20 are advanced in a pulsing fashion, which further facilitates the breakdown of media 2. Pulse mode operation may further be enhanced by utilizing a plurality of sensors 74 to determine the presence or absence of media 2 around casting 1 at a predetermined point along conveyor 20. When casting 1 reaches the predetermined point, if media 2 is not sufficiently removed therefrom, as detected by a photo-eye or infrared sensor 74, controller 70 may send a speed signal 73 to variable frequency drive 80 to increase the resultant angle of vibration Ø such that casting 1 reverses direction on conveyor 20 for a predetermined time or, alternatively, until casting 1 is sensed by a second sensor 74 at a second point along conveyor 20. At this point controller 70 once again initiates pulse mode operation to advance casting 1 while removing media 2 therefrom. This process may reiterate itself until media 2 has been substantially removed from casting 1 whereupon the casting is advanced out of conveyor 20.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

I claim:

1. A method for controlling the speed and direction of an article being conveyed by a conveyor comprising:

providing a vibratory conveyor having a conveying surface and a frame through which a vibratory force may be transmitted to the conveying surface;

positioning said article on said conveying surface at a predetermined location;

imparting a vibratory force to said conveyor at a predetermined angle to said conveying surface whereby the predetermined angle determines the speed and direction of said article on said conveying surface; and automatically modifying the angle of vibratory force imparted to said conveyor after a predetermined time period to modify the speed and direction of said article thereon.

2. A method for controlling the speed and direction of an article being conveyed by a conveyor as claimed in claim 1 wherein said step of imparting a vibratory force to said conveyor comprises:

securing a plurality of shafts capable of rotation to said conveyor; and securing a plurality of eccentric weights to said plurality of shafts whereby a resultant force is applied to said conveyor at an angle to said conveying surface.

3. A method for controlling the speed and direction of an article being conveyed by a conveyor as claimed in claim 2 wherein said step of imparting a vibratory force to said conveyor further comprises:

providing a plurality of electric motors operatively connected to said plurality of shafts for imparting rotation thereto.

4. A method for controlling the speed and direction of an article being conveyed by a conveyor as claimed in claim 3 wherein said step of imparting a vibratory force to said conveyor further comprises:

providing a speed control for at least one of said plurality of electric motors to vary the speed thereof whereby the resultant angle of vibratory force imparted to said conveyor is varied by varying the speed of said at least one electric motor.

5. A method for controlling the speed and direction of an article being conveyed by a conveyor as claimed in claim 4 further comprising:

providing a user input for selecting the speed and direction of said article being conveyed, said user input operatively coupled to said speed control for at least one electric motor.

6. A method for controlling the speed and direction of an article being conveyed by a conveyor as claimed in claim 5 wherein said user input is a numerical keypad.

7. A method for controlling the speed and direction of an article being conveyed by a conveyor as claimed in claim 5 wherein said user input is a potentiometer.

8. A method for controlling the speed and direction of an article being conveyed by a conveyor as claimed in claim 5 wherein said user input is a thumbwheel switch.

9. A method for controlling the speed and direction of an article being conveyed by a conveyor as claimed in claim 5 wherein said user input is a controller having a user interface.

10. A method for controlling the speed and direction of an article being conveyed by a conveyor as claimed in claim 4 further comprising:

providing a plurality of sensors for sensing the position of said article as it travels on the conveying surface.

11. A method for controlling the speed and direction of an article being conveyed by a conveyor as claimed in claim 10 wherein the resultant angle of vibration is varied responsive to the position of said article.

12. A method for controlling the speed and direction of an article being conveyed by a conveyor as claimed in claim 10 wherein the plurality of sensors comprise PIR sensors.

13. A method for controlling the speed and direction of an article being conveyed by a conveyor as claimed in claim 10 wherein the plurality of sensors comprise infrared sensors.

14. A method for controlling the speed and direction of an article being conveyed by a conveyor as claimed in claim 10 wherein the plurality of sensors comprise proximity sensors.

15. A method for controlling the speed and direction of an article being conveyed by a conveyor as claimed in claim 10 wherein the plurality of sensors comprise photo-eye sensors.

16. A method for controlling the speed and direction of an article being conveyed by a conveyor as claimed in claim 10 wherein the plurality of sensors comprise at least one digital camera.

17. A method for controlling the speed and direction of an article being conveyed by a conveyor as claimed in claim 4 further comprising:

providing at least one sensor for monitoring the breakdown of media in a mold, said sensor having an output indicative of a predetermined amount of media breakdown coupled to said speed control.

18. A method for controlling the speed and direction of an article being conveyed by a conveyor as claimed in claim 17 further comprising:

varying the resultant angle of vibration to achieve a predetermined amount of media breakdown prior to advancing said article off said conveyor.

19. A method for controlling the speed and direction of an article being conveyed by a conveyor as claimed in claim 4 further comprising:

providing a speed control for at each of said plurality of electric motors to vary the speed thereof whereby the resultant magnitude of vibratory force imparted to said conveyor is varied by varying the speed of said at least one electric motor.

* * * * *